United States Patent [19]

Greinacher et al.

[11] 4,063,971

[45] Dec. 20, 1977

[54] METHOD OF INCREASING THE COERCIVE FORCE OF PULVERIZED RARE EARTH-COBALT ALLOYS

[75] Inventors: Ekkehard Greinacher; Klaus Reinhardt, both of Essen, Germany; Karl Strnat, Fairborn, Ohio

[73] Assignee: Th. Goldschmidt AG, Essen, Germany

[21] Appl. No.: 116,533

[22] Filed: Feb. 18, 1971

Related U.S. Application Data

[63] Continuation-in-part of Ser. No. 62,005, Aug. 7, 1970, abandoned.

[30] Foreign Application Priority Data

Aug. 8, 1969 Germany ..... 1940464

[51] Int. Cl.[2] ..... H01F 1/02

[52] U.S. Cl. ..... 148/105; 148/31.57; 148/103; 148/108; 427/130; 428/403; 428/900

[58] Field of Search ..... 75/152; 148/31.57, 105, 148/101, 103; 427/127, 130, 132; 29/607; 264/DIG. 58

[56] References Cited

U.S. PATENT DOCUMENTS

| | | | |
|---|---|---|---|
| 2,974,104 | 3/1961 | Paine et al. | 148/105 X |
| 3,523,836 | 8/1970 | Buschow et al. | 75/152 |
| 3,591,428 | 7/1971 | Buschow et al. | 148/31.57 |
| 3,615,914 | 10/1971 | Becker | 148/31.57 X |

FOREIGN PATENT DOCUMENTS

| | | | |
|---|---|---|---|
| 736,923 | 6/1966 | Canada | 148/31.57 |

*Primary Examiner*—Walter R. Satterfield
*Attorney, Agent, or Firm*—Toren, McGeady and Stanger

[57] ABSTRACT

The coercive force of pulverized selected rare earth-cobalt alloys is increased or maintained at least at its initial value by depositing tin on the surface of the alloy particles and subjecting the particles to a heat treatment so as to cause diffusion of the tin into the particle structure.

Permanent magnets formed from tin enriched rare earth-cobalt alloy particles are also disclosed.

11 Claims, 3 Drawing Figures

INVENTORS
EKKEHARD GREINACHER
BY KLAUS REINHARDT
KARL STRNAT
Toren & McGeady
ATTORNEYS INVENTORS
EKKEHARD GREINACHER
KLAUS REINHARDT
KARL STRNAT
BY Toren & McGeady
ATTORNEYS

METHOD OF INCREASING THE COERCIVE FORCE OF PULVERIZED RARE EARTH-COBALT ALLOYS

CROSS REFERENCE TO RELATED APPLICATION

This is a continuation-in-part of Serial No. 62,005 filed Aug. 7, 1970,and now abandoned.

FIELD OF INVENTION

The invention is directed to a method for increasing the coercive force and preventing a decrease of the coercive force of pulverized rare earth-cobalt alloys.

The invention is particularly applicable to rare earth-cobalt alloys which are composed of a rare earth component consisting essentially of one or several of the elements Y, Sc, La, Ce, Pr, Nd, Sm, Eu, Gd, Tb, Dy, Ho, Er, Tm, Yb or Lu, and a second component which consists essentially of cobalt alone or of cobalt in mixture with one or several of the elements manganese, iron, nickel and copper, the ratio of the rare earth component to the cobalt component being between 10–25 atomic percent to 75–90 atomic percent.

BACKGROUND INFORMATION AND PRIOR ART

Rare earth-cobalt alloys are peculiarly suitable for the production of permanent magnets since many such alloys exhibit extremely large uniaxial magnetic crystal anisotropy.

Prior art permanent magnets manufactured from rare earth-cobalt alloys contain a rare earth component which consists essentially of a first component of 10–25 atomic percent of Y, Sc, La, Ce, Pr, Nd, Sm, Eu, Gd, Tb, Dy, Ho, Er, Tm, Yb or Lu, wherein some of the indicated elements may be used alone or at least two or even all of them in mixture, and a second component which amounts to 75–90 atomic percent of the alloy and which consists of cobalt alone or of cobalt in mixture with one or several of the elements manganese, iron, nickel and copper.

For the purposes of this invention, the term "rare earth-cobalt alloys" is therefore primarily directed to alloys of the indication kind, to wit, alloys which consist essentially of 10–25 atomic percent of at least one of the elements Y, Sc, La, Ce, Pr, Nd, Sm, Eu, Gd, Tb, Dy, Ho, Er, Tm, Yb or Lu, and about 75–90 atomic percent of cobalt, or cobalt in mixture with one or several of the elements manganese, iron, nickel and/or copper. The abovementioned elements manganese, iron, nickel and/or copper may replace at most 10 atomic percent of said cobalt.

Rare earth-cobalt alloys of the indicated kind and a method for processing them into permanent magnets have been disclosed in the U.S. Pat. Nos. 3,424,578 and 3,540,945 to which attention is directed.

It is well known by those skilled in this art that pulverized rare earth-cobalt alloys have the important drawback that their coercive force has a tendency to decrease after some time. If permanent magnets composed of such alloys are thus stored for prolonged periods, the decrease in the coercive force is very considerable. This tendency, of course, negatively affects the technical applicability of such alloy powders and permanent magnets made therefrom.

With a view to overcoming this serious drawback and to increasing the coercive force field strength, it has been proposed to treat the alloy powder in a nickel bath or to galvanically coat them with one of several other metals, including tin. The results obtained thereby have, however, not been satisfactory.

It has also been suggested to improve the coercive force characteristics of such rare earth-cobalt alloy powders by subjecting them to an acid treatment. While it is true that such treatments initially increase the coercive force of alloy powders obtained by grinding, it has also been established that such treatments do not prevent the aging phenomena which ultimately result in a reduction of the coercive force. In fact, they appear to accelerate them.

SUMMARY OF THE INVENTION

Figure 1:
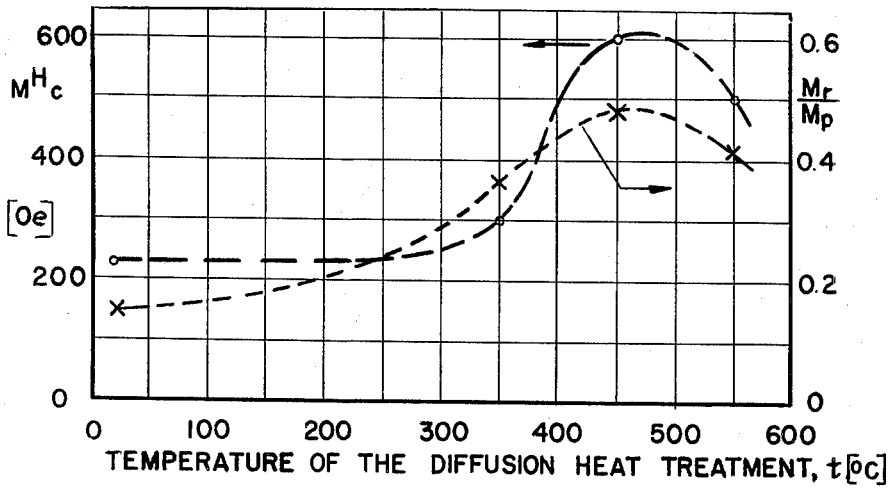
FIG. 1 is a graph showing the dependence of intrinsic coercive force $M^{H}c$, and the residual-to-peak magnetization ratio, $M_r/M_p$, on the temperature of the diffusion heat treatment.
Figure 2:
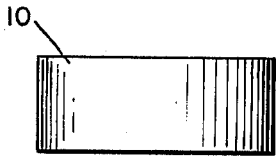
FIG. 2 depicts a permanent magnet 10 of conventional shape.
Figure 3:
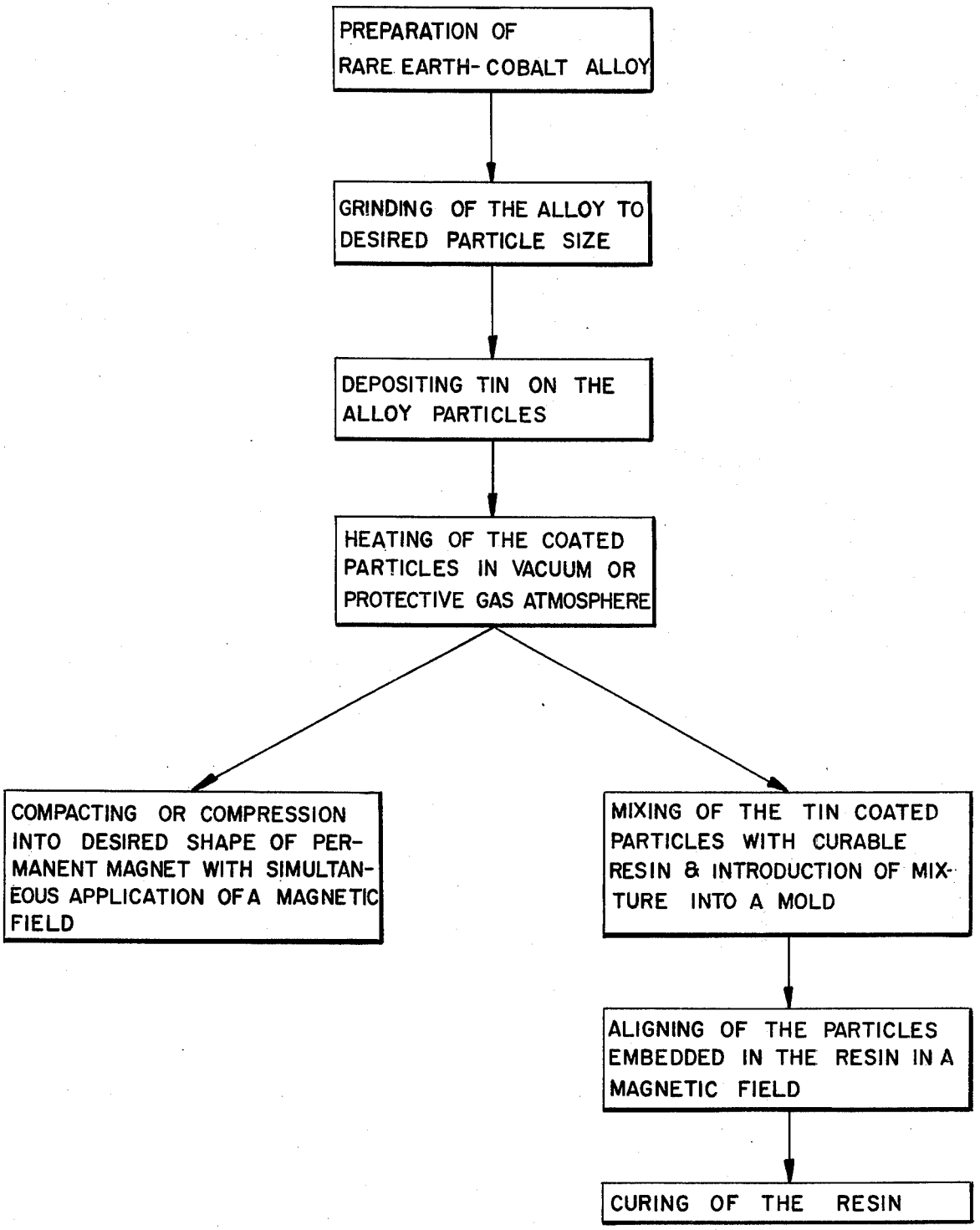
FIG. 3 is a flow sheet showing the method steps for the production of a permanent magnet in accordance with this invention.

It is a primary object of the present invention to provide a method for increasing the coercive force of pulverized rare earth-cobalt alloys of the indicated kind above that imparted by grinding alone.

It is also an object of the invention to provide for a surface treatment of rare earth metal-cobalt alloy powders which stabilizes their magnetic properties, i.e., which is effective to minimize a drop in the coercive force value during prolonged storage of the powder or of magnets made from it.

It is also an object of the invention to provide a surface treatment of the indicated kind which is simple to carry out, does not require any substantial installations and results in a superior product.

Finally, it is an object of the invention to provide a procedure of the indicated kind which facilitates the subsequent processing and shaping of the alloy particles into a permanent magnet including the bonding of the particles to each other or to a matrix.

Generally, it is an object of the invention to improve on the art of beneficially affecting the magnetic characteristics of rare earth-cobalt alloys and of forming permanent magnets therefrom.

Briefly and in accordance with this invention, it has surprisingly been ascertained that the above objects are superiorly obtained by depositing tin on the surface of the alloy particles and subsequently subjecting them to a heat treatment at temperatures sufficient to cause diffusion of deposited tin into the particle structure. The diffusion of the tin into the particle structure is advantageously effected in such a manner that the tin diffuses only partially into those strata or layers of the particles which are adjacent the surface.

Satisfactory results are obtained if the tin layer or deposit on the particle surface is fairly uniform and at least several atomic layers thick. The amount of tin used can lie between approximately 0.1 and 10%, but experiments have indicated that the best result is obtained if the tin deposit, calculated on the weight of the alloy powder, amounts to about 0.5 to 5% by weight.

The subsequent heat treatment of the tin-enriched alloy particles causes that a portion of the tin which surrounds the particles diffuses into the surface strata or layers of the alloy particle. In this context it should be stated that experiments have indicated that the coating of the alloy particles with the tin or another metal in a sour salt solution ("bath") with or without the aid of a current, can increase the coercive force in the same way as an acid treatment in a solution which is free of metal ions. However, this gain is not permanent and the properties decay again. The partial diffusion of the deposited tin causes also an increase of the coercive force by influencing the surface structure of the particles. But, in addition, it prevents an attack of the particle surface by the atmosphere or moisture and thus stabilizes the magnetic properties against the abovementioned decay. This holds true not only at room temperature and below but even at elevated temperatures up to at least 100° C.

Various procedures may be adopted for the purpose of depositing tin on the alloy particles. According to one embodiment, a tin-mercury alloy containing about 1 to 2 percent by weight of tin may be mixed with the pulverized rare earth-cobalt alloy whereupon the mixture is heated, preferably under vacuum conditions. Due to the heating, which is advantageously carried out at temperatures above 200° C., the mercury is expelled and the tin is deposited on the alloy particles. If the heating of the rare earth-cobalt alloy admixed with the tin-mercury alloy is effected at a temperature above 200° C. as stated, then the diffusion of the tin into the rare earth-cobalt alloy particles takes place substantially at the same time since temperatures above 200° C are sufficient to cause such diffusion.

Another mode for obtaining relatively thin tin layers on the alloy particles resides in introducing the pulverized rare earth-cobalt alloy into the aqueous solution of a tin salt. The solid-liquid phase system may be heated to expedite the tin deposition. A rapid and uniform coating of the particle surfaces can also be obtained by effecting the grinding or crushing of the rare earth-cobalt alloy within a tin-salt solution. However, if thicker layers are desired, it is advantageous to facilitate the tin deposition by applying a potential. In this manner the tin is electrolytically deposited on the alloy particles. Particularly excellent results are achieved if the deposition is carried out at relatively low pH values, for example, a pH of between about 2 to 4. The solution may be buffered in customary manner in order to maintain the pH value constant during the electrolytic procedure.

The heat treatment of the tin coated alloy particles is effected at temperatures above 150° C., most advantageously between 300° and 500° C. It will be recalled that in the first embodiment described hereinabove, wherein a tin-mercury alloy is added to the rare earth-cobalt alloy, a temperature above 200° C. was recommended. It will be obvious to a person skilled in this art that the treatment time, to wit, the time necessary for causing sufficient diffusion of the tin into the particle structure, will be shorter if the temperature is higher. From a practical point of view, a treatment temperature will therefore be chosen which assures a sufficiently brief treatment period while at the same time resulting in a diffusion to the desired extent. Generally, it may be stated that within the temperature range of 150° and 500° C., the treatment time may vary from several hours, if the heating is effected at the low to wit, 150° C. value, to a few minutes only if a high temperature such as 500° C. is used.

As stated, the invention also encompasses a procedure for forming or shaping the tin enriched alloy particles into permanent magnets. For this purpose the heating of the tin coated particles for causing the diffusion of the tin into the particle structure may be combined with the shaping of the particles into a permanent magnet. Thus the shaping may be effected while the tin coated particles are heated, if desired, with the simultaneous application of a magnetic field.

The shaping of the alloy powder into a permanent magnet may be effected by compression, compacting, sintering and/or the use of a bonding agent. In this context attention is directed to U.S. Pat. No. 3,424,578, previously referred to, in which various procedures are disclosed. A particular advantage of the inventive procedure resides in the fact that if tin or tin alloys are used as matrix, the tin coated alloy particles exhibit particularly excellent interface bonding characteristics to the surrounding matrix. This in turn, of course, improves the mechanical properties of the magnets. However, the tin coat on the alloy particles exerts also an extremely beneficial effect if an organic binder is used as matrix. This is to because an organic binder alone is not capable of preventing the oxidation of the embedded rare earth-cobalt alloy particles. Due to the tin coat, however, such oxidation is successfully prevented. In addition, the presence of the tin coat improves the bonding characteristics with the organic binder.

The invention will now be described by several examples, it being understood that these examples are given by way of illustration and not by way of limitation and that many changes may be effected without affecting in any way the scope and spirit of this invention as recited in the appended claims.

EXAMPLE 1

PREPARATION OF AN ALLOY CONSISTING OF CERIUM MISCHMETAL AND COBALT 97 g of cerium mischmetal and 203 g of cobalt in pearl or bead form were melted in a corundum crucible. The melting was effected at a temperature of 1450° C. and under argon atmosphere. Within the course of 2 hours the crucible was gradually cooled to 1000° C. whereupon rapid cooling to room temperature was effected. The crucible was then broken and the regulus was cleaned by grinding. The alloy thus obtained was mortar-crushed after the homogenity of the $Co_5$ cerium mischmetal phase, $CeMMCo_5$, has been ascertained metallographically. That portion of the crushed alloy which passed through a sieve of 100μ mesh width was then introduced in a porcelain milling jar with 300 ml of benzene and 2.5 kg of milling balls of 3 mm diameter. The milling jar had a volume of 1 liter. The crushed alloy was thus comminuted or ground for 12 hours. The product thus obtained, after evaporation of the benzene, was separated by means of a sieve of 20μ mesh width into two fractions. The fraction $<20\mu$ was further processed as described in the following examples.

EXAMPLE 2

Preparation of Tin Deposit without Extraneous Current Source 2 g of $CeMMCo_5$ of a particle size of $<20\mu$ were agitated for 3 hours at room temperature in a solution of 0.5 g of $SnCl_2 \cdot 2\,H_2O$ and 0.6g of sodium-potassium-tartrate in 200 ml of water. The solution had been acidified by 0.1 n $H_2SO_4$. The pH of the solution was 3.4. The alloy powder was thereupon washed with water with a view to removing excess tin solution whereupon the powder was dried. A tin content of 0.1% Sn, calculated on the total weight of the allow powder was ascertained.

EXAMPLE 3

Preparation of a Tin Deposit with Extraneous Current Source 2 g of $CeMMCo_5$ with a particle size of $<20\ \mu$ were inserted into a solution containing 1 g of $SnCl_2 \cdot 2\ H_2O$ and 3 g of sodium potassium tartrate in 200 ml of water. The solution had been admixed with 0.1 n $H_2SO_4$ to obtain a pH value of 3.9. The solution with the alloy powder contained therein was subjected to electrolysis for 2 hours at room temperature and under agitation at a current strength of 0.013 amp. The alloy powder was connected as the cathode while very pure tin served as anode. The electrolysis results in the electrolytic deposition of tin on the $CeMMCo_5$ alloy. After washing with water for removal of excess tin solution and drying, a tin content of 0.1% Sn, calculated on the total weight of the alloy powder was ascertained.

EXAMPLE 4

Preparation of a Tin Deposit with Extraneous Current Source 2 g of $CeMMCo_5$ of a particle size of $<50\ \mu$, prepared by mortar grinding and screening, were subjected to electrolysis for 3.5 hours at room temperature in a solution of 0.5 g of $SnCl_2 \cdot 2\ H_2O$ and 0.6 g of sodium tartrate in 200 ml of water. The pH value of the solution was 2.8 which value had been obtained by the addition of 0.1 n $H_2SO_4$. The electrolysis was carried out at a current strength of 0.08 amp. and the electrolysis resulted in the electrolytic deposition of tin on the $CeMMCo_5$-alloy. The alloy powder was the cathode, while very pure tin served as anode. After washing with water for removal of excess tin solution and drying, a tin content of 1.4% Sn, calculated on the total weight of the alloy powder was determined.

EXAMPLE 5

Diffusion Heat Treatment of Coarse Tin-Coated Particles $CeMMCo_5$-powder of $<50\mu$ particle size, electrolytically coated with 1.4 weight% Sn using the procedure of example 4, was divided into fractions of $<20\mu$, 20–37$\mu$ and 37–50$\mu$ by shaking and brushing it through electroformed or wire-mesh screens. The coarsest fraction was used in experiments to optimize the conditions of the diffusion heat treatment.

a. Procedure of Sample Preparation

A small quantity of the powder (~250 mg) was placed in a quartz bulb which was evacuated to approximately $10^{-5}$ Torr, then closed off and heated to the diffusion temperature $T_d$ for the time $t$. After cooling to room temperature, the sample was removed from the vacuum. It was then premagnetized in a field of ~26 kOe, stirred into liquid epoxy resin, magnetically aligned with 4.5 kOe and held that way by the epoxy matrix which was allowed to harden for about 2 hours with the field applied. A hystersis loop was then measured with a maximum applied field of 17.6 kOe parallel to the orientation direction.

b. Optimization of the Temperature of the Diffusion Heat Treatment

The powder samples were heated as described to temperatures of $T_d = 350°, 450°$, and 550° C. Each time, the temperature was reached in about 5 minutes and kept constant at $T_d$ for $t = 10$ minutes, then the samples were cooled rather rapidly. Heating and cooling were achieved by placing the preheated tube furnace of large thermal mass over the quartz tube of ~20 mm diameter and removing it again after the end of the treatment.

The intrinsic coercive force of the powder before it was coated with tin had been ${}_MH_c = 244$ Oe. After coating and storing the powder for several weeks, ${}_MH_c$ was reduced slightly to 233 Oe. The values for the coercive force and for the residual-to-peak magnetization ratio, $M_r/M_p$, are shown in FIG. 1. It can be seen that the magnetic properties are improved. At the temperature $T_d = 450°$ C, the coercivity was raised by a factor 2.6 to 604 Oe. All three samples were remeasured after being stored in air for several months and had substantially the same properties as immediately after the diffusion treatment.

c. Optimization of the Diffusion Time

Additional samples were heated to 450° C for periods $t = 2$, 5 and 30 minutes. The resulting coercive forces are compared in Table I.

Table I:

| Coercive force after different heat-treatment periods | | | | | | |
|---|---|---|---|---|---|---|
| t | [min] | 0 | 2 | 5 | 10 | 30 |
| ${}_MH_c$ | [Oe] | 233 | 480 | 550 | 604 | 590 |

A maximum was reached after 10 minutes. The treatment time is relatively uncritical, but upon prolonged heating the coercivity drops again.

EXAMPLE 6

Diffusion Heat Treatment of Several Size Fractions of Powder Made by Mortar Grinding Tin-coated particle fractions of $<20\mu$ and 20–37$\mu$, prepared as described in example 5, were also heated to 450° C for 10 minutes. The coercive force increased in both cases, initial and final values being higher for these smaller particle sizes, as expected. The coercivities before and after the diffusion heat treatment are shown in Table II below.

Table II:

| Coercive forces of different size fractions before and after heating them in vacuum to 450° C for 10 minutes. | | | | |
|---|---|---|---|---|
| Size fraction [$\mu$] | | <20 | 20 – 37 | 37 – 50 |
| ${}_MH_c$ [Oe] | initial | 1020 | 820 | 233 |
| | final | 2480 | 1760 | 604 |

EXAMPLE 7

Diffusion Heat Treatment of Ballmilled Powders for Pressing

A larger quantity of finer $CeMMCo_5$ powder for the fabrication of pressed magnet samples was prepared by grinding in a ballmill as described in example 1. However, the powder was now used as it came from the mill, that is, it was not classified by sifting. The powder was coated with 1.4% Sn following the general procedure of example 4, and then heated for 10 minutes to 450° C.

The coercive force right after grinding was 2500 Oe. It dropped to 2100 Oe during storage for several weeks. In this condition, the powder was used for the comparison tests, examples 9 and 11. The diffusion treatment raised the coercivity to 4250 Oe at which level it appeared to be stable and unchanged during prolonged room-temperature storage in air.

Example 8

Preparation of a Permanent Magnet 8 g of the tin coated powder produced according to example 7 were placed into a cylindrical pressing die of 1.35 cm diameter, to be compressed between two hardened carbon steel pistons inserted axially. An axial magnetic field was applied with a solenoid surrounding the die. The field was repeatedly turned on and off before pressure was applied, and was then maintained during compacting in an attempt to align the powder particles with their magnetic easy axes parallel to one another. Cylindrical permanent magnet discs of 1.5 g weight and a density of 5.12 g/cm$^3$ were produced at a pressure of 3400 kg. After magnetization with 17.6 kOe the discs had a coercive force of $_M H_c = 4180$ Oe.

EXAMPLE 9

Comparison Example with Alloy Powder Devoid of Tin Coating

A comparison test was effected with an alloy powder pursuant to the procedure of example 7, the alloy powder, however, being devoid of tin. A coercive force value of $_M H_c$ 32 2010 Oe was obtained.

EXAMPLE 10

Preparation of a Permanent Magnet using an Organic Binder as Matrix 8 g of a tin coated alloy powder obtained according to example 7 was intimately mixed with 2 cm$^3$ of a clear lacquer. The lacquer was an acrylic ester resin known in the trade under the tradename Plastiklear No. 225 and was in the form of a colloidal solution having a solid content of 12% by weight. The mixture was dried completely in a stream of warm air of about 50° C. and was repowdered in the mortar. The powder was then compacted, using a die and piston of 2.7 cm while the field was varied between 11000 and 15000 Oe. The result is a disc-shaped magnet of a thickness of about 2.5 mm. The coercive force amounted to $_M H_c = 3990$ Oe.

EXAMPLE 11

Comparison Test with Alloy Powder Devoid of Tin

A comparison test corresponding to the procedure described in example 10 was conducted with an alloy powder of the same nature but devoid of tin. A coercive force value of $_M H_c = 1890$ Oe was obtained.

What is claimed is:

1. A method of maintaining the coercive force of particulate rare earth-cobalt alloys at least at its initial value, which comprises enveloping substantially each alloy particle with a layer of solid tin and then heating the enveloped particles to a temperature sufficiently high so as to cause diffusion of tin into the particle structure.

2. A method as claimed in claim 1, wherein the rare earth-cobalt alloy consists essentially of a rare earth component being composed of one or several of the elements Y, Sc, La, Ce, Pr, Nd, Sm, Eu, Gd, Tb, Dy, Ho, Er, Tm, Yb and Lu, and another component being composed of cobalt alone or cobalt in mixture with at least one of Mn, Fe, Ni or Cu, the ratio of the rare earth component to the other component being about between 10–25 atomic percent to 75–90 atomic percent.

3. A method of maintaining the coercive force of particulate rare earth-cobalt alloys at least at its initial value, said rare earth-cobalt alloy consisting essentially of a first rare earth component being composed of one or several of Y, Sc, La, Ce, Pr, Nd, Sm, Eu, Gd, Tb, Dy, Ho, Er, Tm, Yb and Lu and a second component consisting essentially of cobalt alone or cobalt in mixture with at least one of Mn, Fe, Ni or Cu, the ratio of rare earth component to the second component being about 10–25 atomic percent to 75–90 atomic percent, which comprises depositing tin on the surface of the alloy particles to envelope substantially each particle with a substantially continuous layer of tin and then heating the enveloped alloy particles to a temperature sufficiently high so as to cause diffusion of tin into the particle structure.

4. A method as claimed in claim 3, wherein said heating is effected so that tin diffuses into those strata of the alloy particles which are closest to the particle surface.

5. A method as claimed in claim 3, wherein the tin enveloped particles are heated to a temperature above 150° C.

6. A method as claimed in claim 3, wherein the amount of tin deposited on said particles is about between 0.1 to 5% by weight of tin calculated on the total weight of the alloy.

7. A method as claimed in claim 3, wherein said tin is deposited on said particles by mixing the alloy powder with a tin-mercury alloy and heating the mixture thus obtained until the mercury has been expelled.

8. A method as claimed in claim 7, wherein said heating is effected under vacuum conditions and at a temperature of above 200° C. whereby the heating results not only in the expulsion of mercury but also in the migration of tin into the surface strata of the particles.

9. A method as claimed in claim 3, wherein said heat treatment is combined with shaping said particulate tin enveloped alloy particles into a permanent magnet.

10. A method as claimed in claim 9, wherein magnetic field is applied to the alloy particles during the shaping procedure.

11. A method as claimed in claim 9, wherein the shaping is carried out in the presence of a binder.

* * * * *